US009097998B2

(12) United States Patent
Yamazaki et al.

(10) Patent No.: US 9,097,998 B2
(45) Date of Patent: Aug. 4, 2015

(54) TONER

(75) Inventors: Katsuhisa Yamazaki, Numazu (JP); Shuhei Moribe, Mishima (JP); Daisuke Yoshiba, Suntou-gun (JP); Toru Takahashi, Abiko (JP); Daisuke Tsujimoto, Toride (JP); Masami Fujimoto, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 13/990,369

(22) PCT Filed: Dec. 22, 2011

(86) PCT No.: PCT/JP2011/080556

§ 371 (c)(1),
(2), (4) Date: May 29, 2013

(87) PCT Pub. No.: WO2012/091148

PCT Pub. Date: Jul. 5, 2012

(65) Prior Publication Data

US 2013/0244166 A1 Sep. 19, 2013

(30) Foreign Application Priority Data

Dec. 28, 2010 (JP) ..... 2010-293014

(51) Int. Cl.
*G03G 9/087* (2006.01)
*G03G 9/08* (2006.01)

(52) U.S. Cl.
CPC ..... *G03G 9/087* (2013.01); *G03G 9/0821* (2013.01); *G03G 9/08755* (2013.01); *G03G 9/08795* (2013.01); *G03G 9/08797* (2013.01)

(58) Field of Classification Search
CPC ..... G03G 9/08755; G03G 9/08797
USPC ..... 430/109.4, 111.4
See application file for complete search history.

(56) References Cited

U.S. PATENT DOCUMENTS

| | | | |
|---|---|---|---|
| 5,354,637 | A | 10/1994 | Shimamura et al. |
| 5,406,357 | A | 4/1995 | Nakahara et al. |
| 5,415,967 | A | 5/1995 | Sakashita et al. |
| 5,436,701 | A | 7/1995 | Shimojo et al. |
| 5,447,813 | A | 9/1995 | Hagiwara et al. |
| 5,547,796 | A | 8/1996 | Kohtaki et al. |
| 5,716,746 | A | 2/1998 | Mikuriya et al. |
| 5,968,701 | A | 10/1999 | Onuma et al. |
| 6,020,102 | A | 2/2000 | Fujimoto et al. |
| 6,077,638 | A | 6/2000 | Tanikawa et al. |
| 6,120,961 | A | 9/2000 | Tanikawa et al. |
| 6,156,471 | A | 12/2000 | Kobori et al. |
| 6,187,496 | B1 | 2/2001 | Tanikawa et al. |
| 6,203,959 | B1 | 3/2001 | Tanikawa et al. |
| 6,235,441 | B1 | 5/2001 | Tanikawa et al. |
| 6,426,169 | B1 | 7/2002 | Onuma et al. |
| 6,458,499 | B1 | 10/2002 | Onuma et al. |
| 6,541,174 | B1 | 4/2003 | Tanikawa et al. |
| 6,586,151 | B1 | 7/2003 | Naka et al. |
| 6,589,701 | B2 | 7/2003 | Yamazaki et al. |
| 6,653,036 | B1 | 11/2003 | Tanikawa et al. |
| 6,670,087 | B2 | 12/2003 | Fujikawa et al. |
| 6,703,176 | B2 | 3/2004 | Naka et al. |
| 6,875,549 | B2 | 4/2005 | Yamazaki et al. |
| 6,881,527 | B2 | 4/2005 | Moribe et al. |
| 7,001,703 | B2 | 2/2006 | Moribe et al. |
| 7,097,951 | B2 | 8/2006 | Moribe et al. |
| 7,105,261 | B2 | 9/2006 | Yamazaki et al. |
| 7,147,981 | B2 | 12/2006 | Fujikawa et al. |
| 7,150,953 | B2 | 12/2006 | Yamazaki et al. |
| 7,267,919 | B2 | 9/2007 | Moribe et al. |
| 7,273,686 | B2 | 9/2007 | Onuma et al. |
| 7,288,354 | B2 | 10/2007 | Moribe et al. |
| 7,351,509 | B2 | 4/2008 | Moribe et al. |
| 7,422,832 | B2 | 9/2008 | Ogawa et al. |
| 7,537,877 | B2 | 5/2009 | Yoshiba et al. |

(Continued)

FOREIGN PATENT DOCUMENTS

| | | | |
|---|---|---|---|
| JP | 2003-57874 | A | 2/2003 |
| JP | 2004-191921 | A | 7/2004 |
| JP | 2010-276978 | A | 12/2010 |

OTHER PUBLICATIONS

Diamond, Arthur S & David Weiss (eds.) Handbook of Imaging Materials, 2nd ed.. New York: Marcel-Dekker, Inc. (Nov. 2001) pp. 178-182.*

English language machine translation of JP 2010-276978 (Dec. 2010).*

Yoshiba, et al., U.S. Appl. No. 14/005,250, 371(c) Date: Sep. 13, 2013.

Terauchi, et al., U.S. Appl. No. 13/922,205, filed Jun. 19, 2013.

(Continued)

*Primary Examiner* — Christopher Rodee

(74) *Attorney, Agent, or Firm* — Fitzpatrick, Cella, Harper and Scinto

(57) ABSTRACT

A toner is provided which is superior in the long-term storage stability and has high low-temperature fixing properties. In a DSC curve as measured with a differential scanning calorimeter, the toner has a glass transition temperature of not less than 50° C. and not more than 60° C.; and the toner has, in regard to a resin composition contained therein, a difference of not less than 0.060 W/g in heat flow between a point on the curve at a temperature of 40° C. and a baseline in the range exceeding the glass transition temperature; and in viscoelastic characteristics measured at a frequency of 6.28 rad/sec, the toner has a storage elastic modulus (G'40) at a temperature of 40° C. of not less than $7.0\times10^8$ Pa and not more than $2.0\times10^9$ Pa, and a storage elastic modulus (G'70) at a temperature of 70° C. of not less than $1.0\times10^5$ Pa and not more than $1.0\times10^7$ Pa.

3 Claims, 1 Drawing Sheet

(56) References Cited

U.S. PATENT DOCUMENTS

| | | | | |
|---|---|---|---|---|
| 7,544,455 | B2 | 6/2009 | Yoshiba et al. | |
| 7,638,251 | B2 | 12/2009 | Yamazaki et al. | |
| 7,700,254 | B2 | 4/2010 | Moribe et al. | |
| 7,740,998 | B2 | 6/2010 | Yamazaki et al. | |
| 7,796,926 | B2 | 9/2010 | Matsuda et al. | |
| 7,855,042 | B2 | 12/2010 | Kobori et al. | |
| 7,897,316 | B2 | 3/2011 | Yamazaki et al. | |
| 8,026,030 | B2 | 9/2011 | Moribe et al. | |
| 8,057,977 | B2 | 11/2011 | Moribe et al. | |
| 8,293,447 | B2 | 10/2012 | Yamazaki et al. | |
| 8,501,377 | B2 | 8/2013 | Takahashi et al. | |
| 8,512,925 | B2 | 8/2013 | Moribe et al. | |
| 2004/0086797 | A1* | 5/2004 | Kubo et al. | 430/109.4 |
| 2013/0252167 | A1 | 9/2013 | Moribe et al. | |
| 2013/0302730 | A1 | 11/2013 | Takahashi et al. | |
| 2013/0309603 | A1 | 11/2013 | Takahashi et al. | |

OTHER PUBLICATIONS

Russian Office Action dated May 20, 2014 in Russian Application No. 2013135266.

International Search Report and Written Opinion of the International Searching Authority, International Application No. PCT/JP2011/080556, Mailing Date Jan. 31, 2012.

ASTM D 3418 (1982 (Rev. 1988)): Standard Test Method for Transition Temperature of Polymers by Thermal Analysis, pp. 324-328.

Chinese Office Action dated Feb. 4, 2015 in Chinese Application No. 201180063462.2.

* cited by examiner

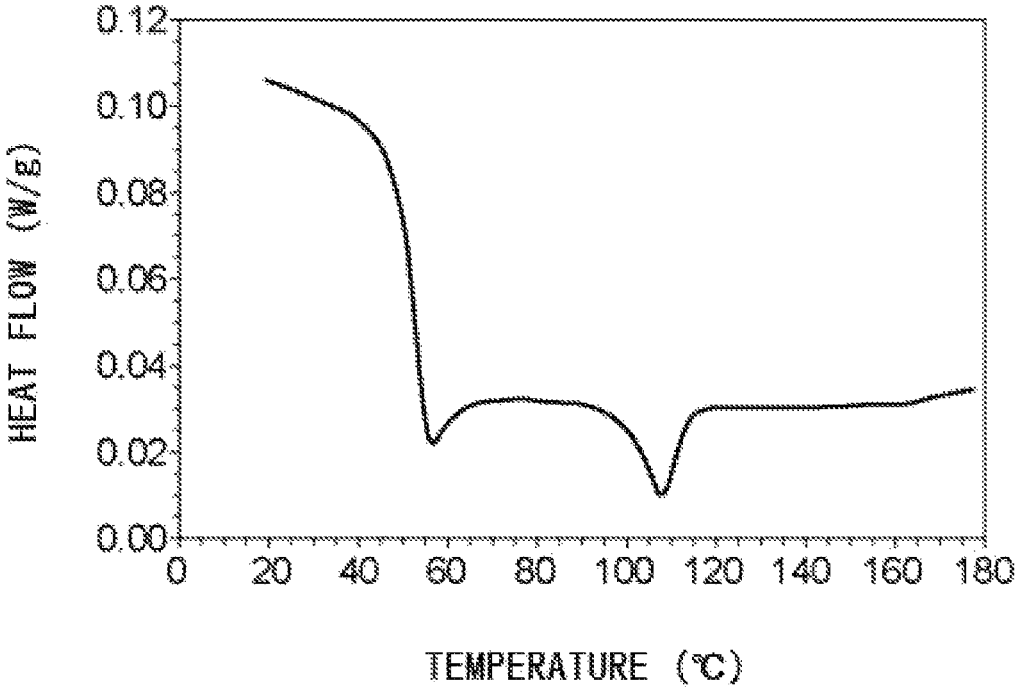
0.12
0.10
0.08
0.06
0.04
0.02
0.00
HEAT FLOW (W/g)
0
20
40
60
80
100
120
140
160
180
TEMPERATURE (℃)

TONER

TECHNICAL FIELD

The present invention relates to electrophotography, a method for forming an image in order to form an electrostatically charged image into a visualized image, and a toner used for toner jet.

BACKGROUND ART

In image forming apparatus using electrophotography technology, a higher speed and higher reliability have been pursued severely. Moreover, such image forming apparatus have been started to be used for printing of super fine images such as graphic design and for quick printing required of more reliability (print-on-demand in which a variety of and a small number of prints during work including from editing to copying of a document with a personal computer and bookbinding can be made).

On the other hand, reduction in energy consumption by the apparatus is highly demanded. In order to comply with such a demand, a toner having high low-temperature fixing properties has been strongly needed. However, there is such a problem that if the low-temperature fixing properties are pursued, off-set resistance (anti-offset properties) and blocking resistance (anti-blocking properties) at a high temperature are reduced.

Then, a variety of toners have been proposed in order to satisfy all the low-temperature fixing properties and the off-set resistance and further blocking resistance at a high temperature. A method is proposed in which a binder resin is made to contain two kinds of resins having different softening points as principal components, and to the binder resin, a crystalline polyester having a low melting point is added to improve the low-temperature fixing properties while the off-set resistance and blocking resistance are maintained (see PTL 1). Another method is proposed in which a block polyester including a crystalline block and a non-crystalline block is used as a binder resin to provide a toner having resistance to mechanical stress and sufficient fixing properties (fixing strength) in a wide range of temperature (see PTL 2).

In the methods for producing a toner described in these documents, however, crystallinity of the crystalline component is reduced in a melt kneading step or the like. For this reason, the effect of the crystalline component contained is not sufficiently demonstrated. Accordingly, there is still room for improvement from the viewpoint of keeping stable performances in a long-term use.

As described above, even if the resin itself has sufficient crystallinity, when the resin is formed into a toner, its crystallinity may be lost or reduced to a great extent in many cases. It is difficult to keep the crystalline state of crystalline substances at a high level after forming it into a toner.

Moreover, it is essential to improve dispersibility of other raw material in order to stably keep the quality for a long period of time. However, it is difficult to enhance the dispersibility of other raw material while the crystallinity is kept. To keep the crystallinity of the crystalline substance and to keep the dispersibility of other raw material are not sufficiently satisfied at the same time.

CITATION LIST

Patent Literature

PTL 1: Japanese Patent Application Laid-Open No. 2003-57874

PTL 2: Japanese Patent Application Laid-Open No. 2004-191921

SUMMARY OF INVENTION

Technical Problem

An object of the present invention is to provide a toner that overcomes the problems described above.

An object of the present invention is to provide a toner having high long-term storage stability (blocking resistance), good low-temperature fixing properties and off-set resistance.

Solution to Problem

According to the present invention, there is provided a toner comprising toner particles each of which contains a binder resin and a coloring agent, wherein: in a DSC curve as measured with a differential scanning calorimeter, the toner has a glass transition temperature of not less than 50° C. and not more than 60° C.; and the toner has, in regard to a resin composition contained therein, a difference of not less than 0.060 W/g in heat flow between a point on the curve at a temperature of 40° C. and a baseline in the range exceeding the glass transition temperature; and in viscoelastic characteristics measured at a frequency of 6.28 rad/sec, the toner has a storage elastic modulus (G'40) at a temperature of 40° C. of not less than $7.0\times10^8$ Pa and not more than $2.0\times10^9$ Pa, and a storage elastic modulus (G'70) at a temperature of 70° C. of not less than $1.0\times10^5$ Pa and not more than $1.0\times10^7$ Pa.

Advantageous Effects of Invention

According to the present invention, a toner having high stability in long-term storage and good low-temperature fixing properties and low-temperature off-set resistance can be obtained.

Further features of the present invention will become apparent from the following description of exemplary embodiments with reference to the attached drawings.

BRIEF DESCRIPTION OF DRAWING

FIG. 1 shows an example of a DSC curve of a binder resin contained in a toner according to the present invention.

DESCRIPTION OF EMBODIMENTS

In order to obtain a toner having good low-temperature fixing properties so as to allow good fixing irrespective of the construction of the fixing unit or the fixing speed, the toner needs to be molten in an instant for which a transfer material passes through a nip of a fixing unit.

However, in order to obtain superior low-temperature fixing properties, in the case where the melting properties of the binder resin itself are controlled according to the low-temperature fixing properties, the off-set resistance and blocking resistance at a low temperature are undesirably reduced. This is also true of the case where a fixing aid is contained in the binder resin, and its plastic effect is used to control the melting properties of the binder resin according to the low-temperature fixing properties.

Namely, in many cases, improvement in the low-temperature fixing properties is traded off for the off-set resistance and blocking resistance.

As a result of further studies of compatibility of the low-temperature fixing properties with the off-set resistance, the inventors have found out that change of the internal state of the toner around the glass transition temperature influences the behavior of the toner at a very initial stage of fixing (at a stage in which a transfer material carrying a non-fixed toner image enters the fixing unit, and the temperature of the leading end of the toner image is raised). It has also been found out that the behavior of the toner at the very initial stage influences the fixing properties throughout the fixing step (low-temperature fixing properties and off-set resistance).

The toner according to the present invention has a glass transition temperature of not less than 50° C. and not more than 60° C. in the DSC curve obtained by measurement with a differential scanning calorimeter. Moreover, in regard to the resin composition in the toner, a difference of heat flow (W/g) between a temperature of 40° C. and a baseline in a region exceeding the glass transition temperature is not less than 0.060 W/g.

A glass transition temperature less than 50° C. indicates that change of the state of the binder resin contained in the toner starts at a temperature close to room temperature. In such a case, storage stability of the toner is reduced. Moreover, at the time of fixing, the binder resin is undesirably reacted upon a slight increase in the temperature to reduce the melt viscosity of the toner existing in the vicinity of the surface of the toner layer, leading to poor off-set properties at a low temperature.

On the other hand, a glass transition temperature more than 60° C. indicates that molecular motion of the binder resin in the toner starts slowly. In such a case, the low-temperature fixing properties are reduced.

Moreover, the toner according to the present invention has, in regard to the resin composition in the toner, a difference of not less than 0.060 W/g in heat flow between a temperature of 40° C. and a baseline in a region exceeding the glass transition temperature. Compared to the ordinary toner, the difference of heat flow in the vicinity of the glass transition temperature is extremely large. A large difference of heat flow means that drastic molecular motion occurs.

In the toner having a difference of heat flow of not less than 0.060 W/g, change of the state of the binder resin contained in the toner in the vicinity of the glass transition temperature is sufficiently large, and the molecules are oriented quickly. For this reason, such a toner is smoothly molten at the initial stage of fixing, allowing good fixing. At a difference of heat flow less than 0.060 W/g, change of the state of the binder resin contained in the toner in the vicinity of the glass transition temperature is small, and this is insufficient as a trigger for good fixing.

In order to increase the difference of heat flow in the vicinity of the glass transition temperature, a resin component in which molecules are easily oriented may be used as design of the molecules in which molecular motion drastically occurs. By use of such a resin, the melting properties of the binder resin contained in the toner greatly change in the corresponding temperature region.

The toner according to the present invention has the properties described above. In addition to that, in the viscoelastic characteristics of the toner measured at a frequency of 6.28 rad/s, the toner has a storage elastic modulus (G'40) at a temperature of 40° C. of not less than $7.0\times10^8$ Pa and not more than $2.0\times10^9$ Pa, and a storage elastic modulus (G'70) at the temperature 70° C. of not less than $1.0\times10^5$ Pa and not more than $1.0\times10^7$ Pa. G'70 is preferably not less than $1.0\times10^5$ Pa and not more than $5.0\times10^6$ Pa. The toner that satisfies the specification above has high low-temperature fixing properties and off-set resistance at a low temperature, and also shows high blocking resistance.

Conventionally, of the toners having a glass transition temperature of not less than 50° C. and not more than 60° C. in the DSC curve as measured with a differential scanning calorimeter, and having, in regard to the resin composition in the toner, a difference of heat flow between a temperature of 40° C. and a baseline in a region exceeding the glass transition temperature, of not less than 0.060 W/g, there is no toner that satisfies the storage elastic modulus above. Usually, as to a toner having the glass transition temperature and the difference of heat flow between 40° C. and a baseline in a region exceeding the glass transition temperature as specified in the invention, the value of the storage elastic modulus at 70° C. (G'70) is undesirably less than $1.0\times10^5$ Pa.

Concerning the toner according to the present invention, in the viscoelastic characteristics of the toner measured at a frequency of 6.28 rad/s, the loss elastic modulus at a temperature of 70° C. (G"70) is preferably not less than $1.0\times10^5$ Pa and not more than $1.0\times10^7$ Pa. At a loss elastic modulus (G"70) less than $1.0\times10^5$ Pa, the viscosity of the toner is likely to be excessively reduced immediately after the transfer material enters the fixing unit, leading to poor off-set properties at a low temperature. A loss elastic modulus (G"70) more than $1.0\times10^7$ Pa indicates that the motion of the binder resin in the toner starts slowly. In such a case, the low-temperature fixing properties are likely to be reduced.

In the DSC curve measured with a differential scanning calorimeter, the binder resin contained in the toner preferably has a first endothermic peak P1 at a temperature not less than 55° C. and not more than 75° C. and a second endothermic peak P2 at a temperature not less than 80° C. and not more than 120° C. The first endothermic peak P1 is more preferably not less than 55° C. and not more than 70° C. The second endothermic peak P2 is more preferably not less than 85° C. and not more than 115° C.

Although the detail of the differential scanning calorimetry will be described later, the endothermic peak in the present invention depends on the endothermic calorie when the binder resin is once heated to 200° C. to be molten, and cooled to be solidified, and the temperature is raised again to melt the binder resin. Even in the second process of raising the temperature, the endothermic peaks P1 and P2 appear. This shows that the binder resin according to the present invention has high crystallinity, and the molecules are easily oriented. Because of such a resin, even if the resin is melt kneaded and incorporated into a toner, the resin can keep the endothermic peaks P1 and P2 as a resin contained in the toner.

The glass transition temperature of the toner is attributed to the resin contained in the toner. Accordingly, the toner according to the present invention contains a resin having a glass transition temperature of not less than 50° C. and not more than 60° C. In the resin having a glass transition temperature of not less than 50° C. and not more than 60° C., the endothermic peak P1 appearing in the range of not less than 55° C. and not more than 70° C. is attributed to "enthalpy relaxation" that occurs immediately after a phase is transited from a glass state to a supercooled liquid. The enthalpy relaxation is found in the case where the molecules move to be oriented immediately after the phase of a polymer is transited from a glass state to a supercooled liquid, and is found in the resin whose molecular chain is easily oriented. In the case where the endothermic peak P1 appears at a temperature of not less than 55° C. and not more than 75° C., this means that the molecular motion occurs instantly when the toner receives heat at an initial stage of fixing. Accordingly, the toner is smoothly molten at the initial stage of fixing.

If the endothermic peak P1 appears at a temperature less than 55° C., the glass transition temperature is highly possibly less than 50° C., and the storage stability of the toner is likely to be reduced. On the other hand, in the case where the endothermic peak P1 appears at a temperature more than 75° C., it is thought that the appearing peak is not attributed to the enthalpy relaxation, and the resin is considered to be a resin not showing the enthalpy relaxation and having an extremely small amount of enthalpy relaxation. Such a resin only shows inferior effect as compared with the resin having the endothermic peak P1 in the range of not less than 55° C. and not more than 75° C.

Further, the endothermic peak P1 preferably has an endothermic calorie ΔH1 of not less than 0.20 J/g and not more than 1.50 J/g, and more preferably an endothermic calorie ΔH1 of not less than 0.25 J/g and not more than 1.20 J/g. If the endothermic peak P1 has the endothermic calorie in the range above, the toner is molten faster when the temperature is raised, and better low-temperature fixing properties can be achieved while production of the off-set at a low temperature is suppressed.

The endothermic peak P2 appearing at a temperature of not less than 80° C. and not more than 120° C. indicates the presence of a crystalline portion produced by orientation of part of the molecular chains of the binder resin. Accordingly, the binder resin in the toner drastically starts to be molten at the peak as a starting point. Such an endothermic peak is provided on the side of the temperature higher than that at which the enthalpy relaxation occurs. Thereby, the binder resin in the toner particles bursts into melting. It is found out that for this reason, the toner is molten on the surface of the toner particles that directly receives the heat of fixing and within the toner particles with no time difference, and the melting speed of the whole toner particles is accelerated.

In the case where the endothermic peak P2 appears at a temperature less than 80° C., the whole toner is molten at a low temperature. Accordingly, while the low-temperature fixing properties are improved, the off-set resistance at a low temperature is inferior to that in the case where the endothermic peak P2 appears in the range above. On the other hand, in the case where the endothermic peak P2 appears at a temperature more than 120° C., the low-temperature fixing properties may be inferior to those in the case where the endothermic peak P2 appears in the range above.

The endothermic calorie ΔH2 of the endothermic peak P2 is preferably not less than 0.20 J/g and not more than 2.00 J/g, and more preferably not less than 0.50 J/g and not more than 1.80 J/g. If the endothermic calorie at the endothermic peak P2 is in the range above, the fixing properties can be more compatible with the storage stability.

Further, in order to quickly melt the toner in an instant during which the transfer material passes through the nip of the fixing unit without off-set, preferably, the relationship between the endothermic calorie ΔH1 of the first endothermic peak P1 and the endothermic calorie ΔH2 of the second endothermic peak P2 is $\Delta H1 \leq \Delta H2$.

The endothermic calorie of the endothermic peak represents an amount of change when the molecules change. Accordingly, as the endothermic calorie is larger, the whole molecules are likely to move more easily. Accordingly, in a case of $\Delta H1 \leq \Delta H2$, the effect of melting the existing crystalline component strongly acts to accelerate the melting speed of the whole toner particles. Thus, fast fixing becomes possible.

Preferably, the above requirement concerning the DSC endothermic peak is achieved, not by blending a resin having the endothermic peak P1 with a resin having the endothermic peak P2, but by using one kind of resin having a glass transition temperature of not less than 50° C. and not more than 60° C. and the endothermic peaks P1 and P2. Because the requirement is satisfied by one kind of resin, the melting state of the whole binder resin in the toner can be controlled, and the obtained effect is particularly remarkable.

As the binder resin used in the present invention, from the viewpoint of orienting part of the molecules to provide crystallinity, polyester resins are preferable. Among them, linear polyesters are particularly preferable.

The components that can be particularly preferably used for synthesizing the polyester resin in the present invention are as follows.

Examples of divalent acid components include dicarboxylic acids or derivatives thereof as follows: benzenedicarboxylic acids, anhydrides thereof, or lower alkyl esters thereof such as phthalic acid, terephthalic acid, isophthalic acid, and phthalic anhydride; alkyl dicarboxylic acids, anhydrides thereof, or lower alkyl esters thereof such as succinic acid, adipic acid, sebacic acid, and azelaic acid; alkenyl succinic acids or alkyl succinic acids, anhydrides thererof, or lower alkyl esters thereof such as n-dodecenylsuccinic acid and n-dodecylsuccinic acid; and unsaturated dicarboxylic acids, anhydrides thereof, or lower alkyl esters thereof such as fumaric acid, maleic acid, citraconic acid, and itaconic acid.

In order to orient part of polymer chains of the binder resin to provide crystallinity, aromatic dicarboxylic acids having a strong flat structure, including a large amount of electrons non-localized by the π electron system, and easy to orient by the π-π interaction are preferably used. Particularly preferable are terephthalic acid and isophthalic acid which easily have a linear structure. The content of the aromatic dicarboxylic acid is preferably not less than 50 mol %, and more preferably not less than 70 mol % based on the acid component that forms the polyester resin. In this case, the crystalline resin is easily obtained, and the temperature of the endothermic peak is easily controlled.

Examples of a divalent alcohol component include: ethylene glycol, polyethylene glycol, 1,2-propanediol, 1,3-propanediol, propyleneglycol, 1,3-butanediol, 1,4-butanediol, 2,3-butanediol, diethylene glycol, triethylene glycol, 1,5-pentanediol, 1,6-hexanediol, neopentyl glycol, 2-methyl-1,3-propanediol, 2-ethyl-1,3-hexanediol, 1,4-cyclohexanedimethanol (CHDM), hydrogenated bisphenol A, bisphenols represented by the formula (1);

[Formula 1]

(1)

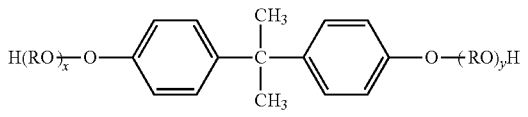

(wherein R is an ethylene or propylene group, x and y each are an integer of not less than 0, and the average value of x+y is 0 to 10.)

and derivatives thereof, and diols represented by the formula (2):

[Formula 2]

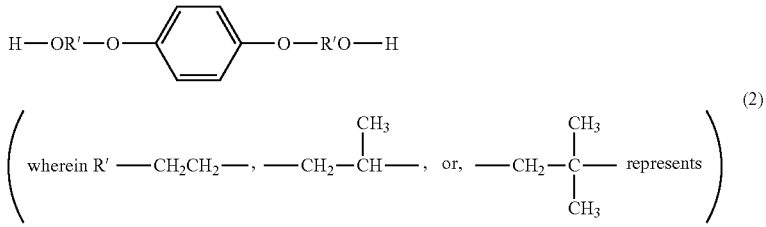

Among these, preferable are linear aliphatic alcohols having 2 to 6 carbon atoms and being easy to have a linear structure from the viewpoint of orienting part of the molecules to provide crystallinity.

If only the alcohol easily having a linear structure is used, the binder resin has an excessively high degree of crystallization and thus loses the amorphous property. Accordingly, other alcohol component is used in combination so as to properly break the crystal structure of the binder resin, and adjustment is needed such that the endothermic peak P1 attributed to the enthalpy relaxation and the endothermic peak P2 attributed to orientation of the molecules appear. For this, particularly preferable is the use of neopentyl glycol, 2-methyl-1,3-propanediol, 2-ethyl-1,3-hexanediol, and the like that have a linear structure and have a substituent in the side chain in which crystallinity can be sterically broken. The proportion of these alcohol components is preferably 20 to 50 mol %, and more preferably 25 to 40 mol % based on the whole alcohol component.

Other than the divalent carboxylic acid compound and divalent alcohol compound described above, the polyester resin used in the present invention may contain a monovalent carboxylic acid compound, a monovalent alcohol compound, a carboxylic acid compound having a valence of 3 or more, and an alcohol compound having a valence of 3 or more as the component. Examples of the monovalent carboxylic acid compound include aromatic carboxylic acids having not more than 30 carbon atoms such as benzoic acid and p-methylbenzoic acid; and aliphatic carboxylic acids having not more than 30 carbon atoms such as stearic acid and behenic acid. Examples of the monovalent alcohol compound include aromatic alcohols having not more than 30 carbon atoms such as benzyl alcohol; and aliphatic alcohols having not more than 30 carbon atoms such as lauryl alcohol, cetyl alcohol, stearyl alcohol, and behenyl alcohol. Examples of the carboxylic acid compound having a valence of 3 or more include trimellitic acid, trimellitic anhydride, and pyromellitic acid. Examples of the alcohol compound having a valence of 3 or more include trimethylolpropane, pentaerythritol, and glycerol.

The method for producing a polyester resin that can be used as the binder resin is not particularly limited, and a known method can be used. For example, the carboxylic acid compound and the alcohol compound mentioned above are together charged to a reaction vessel and subjected to an esterification reaction or a transesterification reaction and a condensation reaction to be polymerized. Thus, a polyester resin is produced. In polymerization of the polyester resin, for example, a polymerization catalyst such as titanium tetrabutoxide, dibutyltin oxide, tin acetate, zinc acetate, tin disulfide, antimony trioxide, and germanium dioxide can be used.

In molecular weight distribution measured by gel permeation chromatography (GPC) of a THF-soluble matter, the binder resin has at least one peak in a region of the molecular weight of not less than 5,000 and not more than 10,000, and in the chart of the GPC, the area of a peak in a region of a molecular weight of not more than 3,000 is preferably not more than 20% based on the whole area of peaks. The ratio Mw/Mn of the weight-average molecular weight Mw to the number average molecular weight Mn is preferably not less than 1 and not more than 30. At a peak molecular weight within the above range, the blocking resistance can be made more compatible with the fixing properties. Moreover, if the proportion of the area at the molecular weight of not more than 3,000 in the GPC chart is within the range, high storage properties can be obtained. Further, if the Mw/Mn is within the range, the off-set resistance at a high temperature is more easily made compatible with the low-temperature fixing properties.

From the viewpoint of fixing properties and storage properties, the glass transition temperature of the binder resin is preferably not less than 50° C. and not more than 60° C., and more preferably not less than 55° C. and not more than 58° C.

Preferably, the acid value of the binder resin is not less than 5 mgKOH/g and not more than 50 mgKOH/g. At an acid value within the range above, when the toner is formed, metal crosslinking using an organic metal complex used as a charge control agent can be introduced into the toner particles. Thereby, while the crystalline state of the binder resin is kept, the viscosity specified in the present invention can be easily provided. The charge control agent will be described later.

In order to provide the binder resin having the endothermic peaks P1 and P2 specified in the present invention with an acid value within the range above, the acid value needs to be adjusted while an influence on the structure of the whole binder resin is suppressed. Examples of a preferable method include a method for post adding a polyfunctional monomer component such as trimellitic anhydride immediately before the polymerization reaction of other monomer component during a period from the latter half of the polymerization reaction of other monomer component immediately before the polymerization reaction of other monomer component is terminated. The proportion of the polyfunctional monomer component to be added here is preferably 1 to 10 mol % based on the other monomer component.

The toner according to the present invention may be either a magnetic toner or a non-magnetic toner.

If a magnetic toner is used, the toner preferably contains a magnetic material. As the magnetic material, iron oxides such as magnetite, maghemite, and ferrite are used. In order to improve the fine dispersibility of the magnetic material in the toner particles, a treatment of applying a shear force to a slurry during production to disentangle aggregation of the magnetic material is preferably performed. The amount of the magnetic material is preferably not less than 25% by mass and not more than 45% by mass, and more preferably not less than 30% by mass and not more than 45% by mass in the toner particles.

These magnetic materials have magnetic properties upon application of 795.8 kA/m, including a coercivity of not less than 1.6 kA/m and not more than 12.0 kA/m, and a saturation magnetization of not less than 50.0 $Am^2/kg$ and not more than 200.0 $Am^2/kg$ (preferably not less than 50.0 $Am^2/kg$ and not more than 100.0 $Am^2/kg$). Further, the residual magnetization is preferably not less than 2.0 $Am^2/kg$ and not more than 20.0 $Am^2/kg$. The magnetic properties of the magnetic material can be measured using a vibration magnetometer, for example, a VSM P-1-10 (made by Toei Industry Co., Ltd.).

In the case where a non-magnetic toner is used, carbon black and one or two or more other known pigments and dyes can be used as a coloring agent. The amount of the coloring agent is preferably not less than 0.1 parts by mass and not more than 60.0 parts by mass, and more preferably not less than 0.5 parts by mass and not more than 50.0 parts by mass based on 100.0 parts by mass of the resin component.

In the present invention, in order to give release properties to the toner, a mold release agent can be used when necessary. As the mold release agent, aliphatic hydrocarbon wax is preferable. Examples of the aliphatic hydrocarbon wax include: low molecular weight alkylene polymers obtained by radical polymerizing alkylenes under high pressure, or polymerizing alkylenes under low pressure using a Ziegler catalyst; alkylene polymers obtained by thermally decomposing a high molecular weight alkylene polymer; synthesized hydrocarbon waxes obtained from a distillation residue of hydrocarbon obtained from a synthesis gas containing carbon monoxide and hydrogen by the Arge method, and synthesized hydrocarbon waxes obtained by hydrogenation of the synthesized hydrocarbon waxes; and those obtained by separating these aliphatic hydrocarbon waxes by a press perspiring method, a solvent method, vacuum distillation, or fractional crystallization.

Examples of hydrocarbons as the base of the aliphatic hydrocarbon wax include: those synthesized by a reaction of carbon monoxide with hydrogen using a metal oxide catalyst (two or more multidisciplinary catalysts in many cases) (for example, hydrocarbon compounds synthesized by a Syntol method or a Hydrocol method (using a fluidized catalyst bed)); and hydrocarbons having hundreds carbon atoms at most and obtained by the Arge method by which a large number of wax hydrocarbons is obtained (using a fixed catalyst bed); and hydrocarbons obtained by polymerizing alkylenes such as ethylene by the Ziegler catalyst. Among these hydrocarbons, saturated and long linear hydrocarbons, less and small branched, are preferable in the present invention. Particularly, hydrocarbons synthesized by a method not using polymerization of alkylenes are preferable because of their molecular weight distribution.

For example, specific examples thereof include: VISCOL (registered trademark) 330-P, 550-P, 660-P, TS-200 (made by Sanyo Chemical Industries, Ltd.), HIWAX 400P, 200P, 100P, 410P, 420P, 320P, 220P, 210P, and 110P (made by Mitsui Chemicals, Inc.), SASOL H1, H2, C80, C105, and C77 (made by Schumann Sasol Co.), HNP-1, HNP-3, HNP-9, HNP-10, HNP-11, and HNP-12 (made by Nippon Seiro Co., Ltd.), UNILIN (registered trademark) 350, 425, 550, 700, UNICID (registered trademark), UNICID (registered trademark) 350, 425, 550, and 700 (made by Toyo-Petrolite Co., Ltd.), japan wax, bees wax, rice wax, candelilla wax, and carnauba wax (available from CERARICANODA Co., Ltd.).

When necessary, one or two or more mold release agents may be used in combination with the hydrocarbon wax. Examples of the mold release agent that can be used in combination include:

oxides of aliphatic hydrocarbon waxes such as polyethylene oxide wax or block copolymers thereof; waxes including fatty acid ester such as carnauba wax, SASOL wax, and montanic acid ester wax as a principal component; partially or completely deacidified fatty acid esters such as deacidified carnauba wax; saturated linear fatty acids such as palmitic acid, stearic acid, and montanic acid; unsaturated fatty acids such as brassidic acid, eleostearic acid, and parinaric acid; saturated alcohols such as stearyl alcohol, aralkyl alcohol, behenyl alcohol, carnaubyl alcohol, ceryl alcohol, and melissyl alcohol; long-chain alkyl alcohols; polyhydric alcohols such as sorbitol; fatty acid amides such as linoleic acid amide, oleic acid amide, and lauric acid amide; saturated fatty acid bisamides such as methylenebis stearic acid amide, ethylenebis capric acid amide, ethylenebis lauric acid amide, and hexamethylenebis stearic acid amide; unsaturated fatty acid amides such as ethylenebis oleic acid amide, hexamethylenebis oleic acid amide, N,N'-dioleyladipic acid amide, and N,N'-dioleylsebacic acid amide; aromatic bisamides such as m-xylenebis stearic acid amide, and N,N'-distearyl isophthalic acid amide; fatty acid metallic salts such as calcium stearate, calcium laurate, zinc stearate, and magnesium stearate (generally referred to as metal soap); aliphatic hydrocarbon waxes grafted with a vinyl monomer such as styrene and acrylic acid; partially esterified products of a fatty acid such as behenic acid monoglyceride and a polyhydric alcohol; and methyl ester compounds having a hydroxyl group obtained by hydrogenating plant fat or oil.

The timing to add the mold release agent may be the time of melt kneading during production of a toner or the time of producing a binder resin. It is properly selected from the existing methods. These mold release agents may be used alone or in combination. Preferably, the amount of the mold release agent to be added is not less than 1 part by mass and not more than 20 parts by mass based on 100 parts by mass of the binder resin.

In the toner according to the present invention, a charge control agent is preferably used in order to stabilize the charging properties. Depending on kinds and physical properties of other toner particle forming material, usually, the charge control agent contains preferably not less than 0.1 parts by mass and not more than 10 parts by mass, and more preferably not less than 0.1 parts by mass and not more than 5 parts by mass based on 100 parts by mass of the binder resin. An effective charge control agent is an organic metal complex or chelate compound having a central metal and easily interactive with an acid group or hydroxyl group that the binder resin has. Examples thereof include monoazo metal complexes; acetylacetone metal complexes; and metal complexes or metal salts of aromatic hydroxycarboxylic acids or aromatic dicarboxylic acids.

Examples of the charge control agent metal-crosslinkable by the interaction with a carboxyl group that the binder resin has include aluminum salicylate compounds.

Specific examples of the charge control agent to be used include Spilon Black TRH, T-77, and T-95 (HODOGAYA CHEMICAL CO., LTD.), and BONTRON (registered trademark) S-34, S-44, S-54, E-84, E-88, and E-89 (ORIENT CHEMICAL INDUSTRIES CO., LTD.). Moreover, the above charge control agent can be used in combination with a charge control resin.

In the toner according to the present invention, preferably, as inorganic fine particles, a fluidity improver having a small number average particle diameter of a primary particle and a BET specific surface area of not less than 50 $m^2/g$ and not more than 300 $m^2/g$ is added to the toner particles. Any fluidity improver can be used if the fluidity improver can be externally added to the toner particles to increase the fluidity after addition compared to that before addition. Examples of the fluidity improver include: fluorine resin powders such as vinylidene fluoride fine particles and polytetrafluoroethylene fine particles; fine particle silicas such as wet silica and dry silica, and processed silica obtained by surface treating these silicas with a silane coupling agent, a titanium coupling agent, or silicone oil. A preferable fluidity improver is the fine powder produced by vapor-phase oxidation of silicon halides, which is referred to as dry silica or fumed silica. For example, the process uses a pyrolysis oxidation reaction of silicon tetrachloride gas in oxygen and hydrogen, and the reaction formula is:

$$SiCl_4+2H_2+O_2 \text{--->} SiO_2+4HCl$$

The preferable fluidity improver may be a composite fine powder of silica and other metal oxide obtained by using a metal halide such as aluminum chloride or titanium chloride in combination with a silicon halide in this production step. A silica fine powder having the average primary particle diameter preferably in the range of not less than 0.001 μm and not more than 2 μm and particularly preferably in the range of not less than 0.002 μm and not more than 0.2 μm is preferably used.

More preferably, a processed silica fine powder obtained by hydrophobization of the silica fine powder produced by vapor-phase oxidation of a silicon halide is used. Of the processed silica fine powders, particularly preferable is a silica fine powder treated such that a degree of hydrophobizing titrated by a methanol titration test designates a value in the range of not less than 30 and not more than 80.

As a method of hydrophobization, a chemical treatment is performed by an organic silicon compound that reacts with or physically adsorbs the silica fine powder. As a preferable method, the silica fine powder produced by the vapor-phase oxidation of a silicon halide is treated by an organic silicon compound. Examples of such an organic silicon compound include: hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptan, trimethylsilylmercaptan, triorganosilyl acrylate, vinyldimethylacetoxysilane, dimethylethoxysilane, dimethyldimethoxysilane, diphenyldiethoxysilane, 1-hexamethyldisiloxane, 1,3-divinyltetramethyldisiloxane, 1,3-diphenyltetramethyldisiloxane, and dimethylpolysiloxane having 2 to 12 siloxane units per molecule and including a hydroxyl group bonded to Si in the unit located at a terminal. One of these or a mixture of two or more thereof is used.

The inorganic fine particle may be treated with silicone oil, or may be treated in combination with the hydrophobization.

Preferably, a silicone oil having a viscosity at 25° C. of not less than 30 $mm^2/s$ and not more than 1,000 $mm^2/s$ is used. For example, dimethyl silicone oil, methylphenyl silicone oil, α-methylstyrene-modified silicone oil, chlorophenyl silicone oil, and fluorine-modified silicone oil are particularly preferable.

Examples of a method for silicone oil treatment include: a method for directly mixing a silica fine powder treated with a silane coupling agent with a silicone oil by a mixer such as a Henschel mixer; a method for spraying a silicone oil to a silica fine powder as a base; or a method for dissolving or dispersing a silicone oil in a proper solvent, adding a silica fine powder to the solution, mixing the solution, and removing the solvent. In the silicone oil-treated silica, more preferably, after the treatment of the silicone oil, silica is heated in an inert gas at a temperature not less than 200° C. (more preferably not less than 250° C.) to stabilize the coating of the surface.

Examples of a preferable silane coupling agent include hexamethyldisilazane (HMDS).

In the present invention, preferable are silicas treated by a method for treating silica with a coupling agent in advance and treating silica with a silicone oil, or a method for treating silica with a coupling agent and a silicone oil at the same time.

The amount of the inorganic fine particle is preferably not less than 0.01 parts by mass and not more than 8 parts by mass, and more preferably not less than 0.1 parts by mass and not more than 4 parts by mass based on 100 parts by mass of the toner particles.

the toner according to the present invention, other external additives may be added when necessary. Examples of the external additives include a charging aid, a conductivity agent, a fluidity agent, an anticaking agent, a mold release agent at the time of fixing by a heat roller, a lubricant, and resin fine particles and inorganic fine particles serving as a polishing agent.

Examples of the lubricant include polyfluoroethylene powder, zinc stearate powder, and polyvinylidene fluoride powder. Among them, preferable is polyvinylidene fluoride powder. Examples of the polishing agent include cerium oxide powder, silicon carbide powder, and strontium titanate powder. These external additives are sufficiently mixed with the toner particles using a mixer such as a Henschel mixer.

The toner according to the present invention can be obtained as follows: the binder resin, the coloring agent, and other additives are sufficiently mixed by a mixer such as a Henschel mixer and a ball mill; the mixture is melt kneaded by a heat kneader such as a heat roll, a kneader, and an extruder, and cooled and solidified, followed by grinding and classification; further, when necessary, additives are sufficiently mixed with the obtained product by a mixer such as a Henschel mixer. As the kneader used in the melt kneading step, a biaxial extruder is preferably used because continuous production is allowed. In the present invention, the proportion Ln/L of a kneading section to a distance L from a raw material feeding inlet to an end downstream of a paddle is preferably not less than 0.40 and not more than 0.70 (wherein L represents a distance from the raw material feeding inlet to the end downstream of a paddle, and Ln represents a length of the whole kneading section). The kneading section occupies most of the extruder. Thereby, a shear force can be continuously applied to a kneaded product as much as possible. A melt kneading temperature is preferably a temperature not less than the peak temperature of the second endothermic peak P2 and less than 200° C. In the case where the toner is produced so as to satisfy these specifications, it is easy to control the miscibility of the component partially having crystallinity in the toner with other resin component.

A method for measuring physical properties of the toner according to the present invention is as shown below. The values of the physical properties in Examples described later are also measured by the method.

<Measurement of Glass Transition Temperature, Difference of Heat Flow, Endothermic Peak Temperature, and Endothermic Calorie>

The peak temperature of the endothermic peak is measured using a differential scanning calorimeter "Q1000" (made by TA Instruments, Inc.) according to ASTM D3418-82. The melting points of indium and zinc are used for temperature correction of the detecting unit in the apparatus, and heat of fusion of indium is used for correction of the amount of heat.

Specifically, approximately 5 mg of a sample (the binder resin or the toner) is precisely weighed, and placed in an aluminum pan. Using an empty aluminum pan as a reference, measurement is performed at a measurement temperature of 30° C. to 200° C. and at a temperature raising rate of 10° C./min. In the measurement, the temperature is once raised to 200° C., and subsequently lowered to 30° C. at a temperature falling rate of 10° C./min. Then, again, the temperature is raised at a temperature raising rate of 10° C./min. Using the DSC curve obtained in the second temperature raising process, the physical properties specified in the present invention are determined.

In the DSC curve, a point of intersection of a line from the midpoint of baselines before and after the appearance of specific heat change and the DSC curve is referred to as a glass transition temperature Tg.

From the DSC curve obtained in the second temperature raising process in which the toner is used as the sample, a difference in heat flow between a point on the curve at 40° C. and a baseline in a region exceeding the glass transition temperature is measured. In the case where the baseline does not show a constant heat flow, the difference is calculated using a value at an end point of the endothermic peak P1.

The difference of heat flow is measured with reference to the resin composition in the toner. In the case of the non-magnetic toner, a value obtained from the DSC curve in which the toner is used as the sample is used as it is. In the case of the magnetic toner, the magnetic material is removed, and the difference of heat flow is determined as a value per gram of the remaining component. Specifically, used is a value obtained by dividing the value obtained from the DSC curve in which the toner is used as the sample by the proportion of the mass of the component other than the magnetic material. The proportion of the magnetic material in the toner may be determined by a known method.

In the DSC curve obtained in the second temperature raising process when the binder resin is used as the sample, the endothermic peak appearing on the side of the temperature higher than the glass transition temperature Tg is referred to as the endothermic peak P1, and the endothermic peak obtained by further raising the temperature is referred to as the endothermic peak P2. On the other hand, the endothermic calorie of the endothermic peak ΔH can be determined from an integration value of the region (peak region) surrounded by the baseline and the DSC curve.

<Measurement of Viscoelastic Characteristic of Toner>

As the measurement apparatus, a rotational flat disk type rheometer "ARES" (made by TA INSTRUMENTS, Inc.) is used.

As a sample to be measured, used is a sample obtained by pressure molding the toner into a disk shape having a diameter of 7.9 mm and a thickness of 2.0±0.3 mm under an environment of 25° C. using a tableting machine.

The sample is mounted on a parallel plate. The temperature is then raised from room temperature (25° C.) to 100° C. for 15 minutes to arrange the shape of the sample. Then, the temperature is cooled to a measurement starting temperature for measuring viscoelasticity, and the measurement is started. At this time, it is important to set the sample such that the initial normal force is 0. Moreover, as described below, in the subsequent measurement, the influence of the normal force can be cancelled by auto tension adjustment (Auto Tension Adjustment ON).

The measurement is performed on the following condition.

(1) A parallel plate having a diameter of 7.9 mm is used.

(2) The frequency is 6.28 rad/sec (1.0 Hz).

(3) The initial value of applied strain is set at 0.1%.

(4) The measurement is performed in the range of not less than 30° C. and not more than 200° C. at a temperature raising rate (Ramp Rate) of 2.0° C./min. The measurement is performed on the setting condition of the auto adjustment mode below. The measurement is performed on the auto strain adjustment mode (Auto Strain).

(5) The maximum strain (Max Applied Strain) is set at 20.0%.

(6) The maximum torque (Max Allowed Torque) is set at 200.0 g·cm, and the minimum torque (Min Allowed Torque) is set at 0.2 g·cm.

(7) Strain Adjustment is set at 20.0% of Current Strain. The measurement uses the auto tension adjustment mode (Auto Tension).

(8) The Auto Tension Direction is set at Compression.

(9) The Initial Static Force is set at 10.0 g, and the Auto Tension Sensitivity is set at 40.0 g.

(10) As the operating condition of the Auto Tension, the Sample Modulus is not less than $1.0\times10^3$ Pa.

<Measurement of Molecular Weight Distribution by GPC>

A column is stabilized in a heat chamber at 40° C. THF is flowed into the column at this temperature as a solvent at a flow rate of 1 ml/min, and approximately 100 μl of a THF sample solution is injected. Thus, the measurement is performed. In measuring the molecular weight of the sample, the molecular weight distribution that the sample has is calculated from the relationship between the logarithmic value of the calibration curve created from several kinds of monodisperse polystyrene reference samples and the count value. As the standard polystyrene sample for creation of the calibration curve, for example, a standard polystyrene sample made by Tosoh Corporation or Showa Denko K.K. and having a molecular weight of approximately $10^2$ to $10^7$ is used. A standard polystyrene sample having at least 10 points is preferably used. As a detector, an RI (refractive index) detector is used. The column may be a combination of a plurality of commercially available polystyrene gel columns. Examples thereof include a combination of Shodex GPC KF-801, 802, 803, 804, 805, 806, 807, and 800P made by Showa Denko K.K., and a combination of TSKgel G1000H($H_{XL}$), G2000H ($H_{XL}$), G3000H ($H_{XL}$), G4000H ($H_{XL}$), G5000H ($H_{XL}$), G6000H ($H_{XL}$), G7000H($H_{XL}$), and a TSKguard column made by Tosoh Corporation.

The sample is produced as follows.

A sample is put into THF and left as it is at 25° C. for several hours. Then, by shaking, the sample is sufficiently mixed with THF (until coalescences of the sample disappear) and further left as it is for not less than 12 hours. At this time, the time to leave the sample in THF is for 24 hours. Subsequently, the mixture is passed through a sample processing filter (pore size of 0.2 to 0.5 μm, for example, a MAISHORI DISK H-25-2 (made by Tosoh Corporation) can be used.), and the obtained product is used as the sample for GPC. The concentration of the sample is adjusted such that the resin component is 0.5 to 5 mg/ml.

<Method for Measuring Weight Average Particle Diameter (D4)>

The weight average particle diameter (D4) of the toner is determined as follows. Using an accurate particle size distribution measuring apparatus "COULTER COUNTER Multisizer 3" (registered trademark, made by Beckman Coulter, Inc.) including an aperture tube of 100 μm according to a pore electric resistance method, and the dedicated software "Beckman Coulter Multisizer 3 Version 3.51" attached to the COULTER COUNTER Multisizer 3 for setting the measurement condition and analyzing the obtained data (made by Beckman Coulter, Inc.), the measurement is performed at 25,000 effective measuring channels. The obtained data is analyzed. From the analyzed data, the weight average particle diameter (D4) is calculated.

As an electrolytic aqueous solution used for the measurement, those prepared by dissolving super grade sodium chloride in ion exchange water such that the concentration is approximately 1% by mass, for example, "ISOTON II" (made by Beckman Coulter, Inc.) can be used.

Before the measurement and analysis, the dedicated software is set up as follows.

On the "Change Display of Standard Measurement Method (SOM)" screen of the dedicated software, the total count number of the control mode is set at 50,000 particles, the number of measurement is set at 1, and the Kd value is set at a value obtained using "standard particle of 10.0 μm" (made by Beckman Coulter, Inc.). A threshold/noise measurement button is pressed to automatically set the threshold and noise level. The current is set at 1,600 μA, the gain is set at 2, and the electrolyte solution is set at the ISOTON II. Flush of the aperture tube after the measurement is checked.

On the "Conversion Setting from Pulse to Particle Diameter" screen of the dedicated software, the bin interval is set at the logarithm particle diameter, the particle diameter bin is set at the 256 particle diameter bin, and the range of the particle diameter is set at 2 μm to 60 μm.

A specific measurement method is as follows.

(i) Into a 250 ml round-bottom glass beaker dedicated to Multisizer 3, and approximately 200 ml of the electrolytic aqueous solution is placed. The breaker is set on a sample stand, and the electrolytic aqueous solution is stirred by a stirrer rod counterclockwise at 24 rpm/sec. Then, dirt and bubbles in the aperture tube are removed by the "flush of aperture" function of the analyzing software.

(ii) Approximately 30 ml of the electrolytic aqueous solution is placed into a 100 ml glass flat-bottom beaker. Into this, as a dispersant, approximately 0.3 ml of a diluted solution is added, which solution is prepared by diluting "CONTAMINON N" (a 10% by mass aqueous solution of a neutral detergent with pH 7 for washing a precision measuring apparatus including a nonionic surface active agent, an anionic surface active agent, and an organic builder, made by Wako Pure Chemical Industries, Ltd.) 3 times by mass with ion exchange water.

(iii) A predetermined amount of ion exchange water is placed into a water bath of an ultrasonic disperser "Ultrasonic Dispersion System Tetora 150" (made by Nikkaki-Bios Co., Ltd.) having an electric output of 120 W in which two oscillators with an oscillation frequency of 50 kHz are built-in in the state where a phase of one oscillator is shifted by 180° to that of the other. To the water bath, approximately 2 ml of the CONTAMINON N is added.

(iv) The beaker in (ii) is set in a fixing hole for the beaker in the ultrasonic disperser, and the ultrasonic disperser is operated. The height position of the beaker is adjusted such that the resonance state of the surface of the electrolytic aqueous solution in the beaker is the maximum.

(v) In the state where an ultrasonic wave is applied to the electrolytic aqueous solution in the beaker in (iv), approximately 10 mg of the toner is added to the electrolytic aqueous solution little by little, and dispersed. Further, the ultrasonic dispersion is continued for 60 seconds. In the ultrasonic dispersion, the temperature of water in the water bath is properly adjusted so as to be not less than 10° C. and not more than 40° C.

(vi) Using a pipette, the electrolyte aqueous solution in (v) having a dispersed toner is dropped into the round-bottom beaker in (i) disposed in the sample stand. The measurement concentration is adjusted so as to be approximately 5%. Then, the measurement is performed until the number of particles to be measured reaches 50,000.

(vii) The obtained data is analyzed by the dedicated software attached to the apparatus, and the weight average particle diameter (D4) is calculated. The weight average particle diameter (D4) is the "average diameter" on the analysis/volume statistical value (arithmetic average) screen when graph/% by volume is set by the dedicated software.

<Measurement of Acid Value of Binder Resin>

An acid value is the number of mg of potassium hydroxide needed to neutralize acid contained in 1 g of a sample. The acid value of the binder resin is measured according to JIS K 0070-1992, and specifically, is measured according to the procedure below.

(1) Preparation of Reagent 1.0 g of phenolphthalein is dissolved in 90 ml of ethyl alcohol (95 vol %), and ion exchange water is added to obtain 100 ml of a phenolphthalein solution.

7 g of super grade potassium hydroxide is dissolved in 5 ml of water, and ethyl alcohol (95 vol %) is added to obtain 1 l of the solution. The solution is placed in an alkali-resistant container to prevent the solution from contacting carbon dioxide gas or the like, and left for 3 days. Then, the solution is filtered to obtain a potassium hydroxide solution. The obtained potassium hydroxide solution is preserved in an alkali-resistant container. 25 ml of 0.1 mol/l hydrochloric acid is placed in a conical flask. Several drops of the phenolphthalein solution are added, and titration is performed by the potassium hydroxide solution. The factor of the potassium hydroxide solution is determined from the amount of the potassium hydroxide solution needed for neutralization. The 0.1 mol/l hydrochloric acid to be used is produced according to JIS K 8001-1998.

(2) Operation (A) Main Test 2.0 g of a sample of a pulverized binder resin is precisely weighed and placed into a 200 ml conical flask. 100 ml of a mixed solution of toluene/ethanol (2:1) is added, and the sample is dissolved over 5 hours. Next, several drops of the phenolphthalein solution are added as an indicator, and titration is performed using the potassium hydroxide solution. The end of titration is a time when a light red color of the indicator continues for approximately 30 seconds.

(B) Blank Test

Titration is performed in the same manner as in the operation above except that no sample is used (namely, only the mixed solution of toluene/ethanol (2:1) is used).

(3) The obtained result is substituted into the expression below, and the acid value is calculated.

$$A=[(C-B)\times f\times 5.61]/S$$

wherein A: acid value (mgKOH/g), B: the amount of the potassium hydroxide solution to be added in the blank test (ml), C: the amount of the potassium hydroxide solution to be added in the main test (ml), f: factor of the potassium hydroxide solution, S: sample (g).

<Measurement of Magnetic Properties of Magnetic Iron Oxide Particle>

Using a vibration magnetometer VSM-P7 made by TOEI INDUSTRY CO., LTD., the measurement was performed at a sample temperature of 25° C. and an external magnetic field of 795.8 kA/m.

<Measurement of Average Primary Particle of Magnetic Iron Oxide Particle>

Using a scanning electron microscope (magnification of 40,000 times), magnetic iron oxide particles are observed, the Feret diameters of 200 particles are measured, and the number average particle size is determined. In the present Example, as a scanning electron microscope, an S-4700 (made by Hitachi, Ltd.) was used.

EXAMPLES

Hereinafter, the present invention will specifically be described with reference to Examples. However, the present invention will not be limited by these.

Embodiment 1

<Production of Binder Resin 1>

| | |
|---|---|
| Terephthalic acid | 100 mol parts |
| Ethylene glycol | 60 mol parts |
| Neopentyl glycol | 40 mol parts |

The polyester monomer and an esterification catalyst (dibutyltin oxide) were placed into a 5 liter autoclave. To the autoclave, a reflux cooler, a moisture separator, an $N_2$ gas introducing pipe, a thermometer, and a stirrer were attached. While $N_2$ gas was introduced into the autoclave, a polycondensation reaction was performed at 230° C. The reaction was performed while a degree of the progression of the reaction was monitored using viscosity. When the monitored viscosity reached the target viscosity, 5 mol parts of trimellitic anhydride was added. The relationship between the viscosity and the molecular weight was separately confirmed, and the target viscosity was determined in advance. After the reaction was completed, the produced resin was extracted from the container, cooled, and pulverized to obtain Binder Resin 1. The physical properties of Binder Resin 1 are as shown in Table 2.

<Production of Binder Resins 2 to 13 and 15 to 17>

Binder Resins 2 to 13 and 15 to 17 were produced in the same manner as in production of Binder Resin 1 except that the monomer shown in Table 1 was used. The physical properties of these resins are as shown in Table 2.

<Production of Binder Resin 14>

Binder Resin 14 was produced in the same manner as in production of Binder Resin 1 except that 70 mol parts of Binder Resin 13 (using the peak molecular weight of 7900 as a representative value of the molecular weight, "mol %" was calculated), 15 mol parts of 1,3-propanediol, and 15 mol parts of terephthalic acid were used, and trimellitic anhydride was not additionally added. The physical properties of the resin are shown in Table 2.

TABLE 1

| | Formula (mol parts) | | | | | |
|---|---|---|---|---|---|---|
| | Monomer initially added | | | | | Monomer additionally added |
| Binder resin 1 | TPA (100) | EG (60) | NPG (40) | — | — | TMA (5) |
| Binder resin 2 | TPA (100) | EG (60) | NPG (40) | — | — | EG (10) |
| Binder resin 3 | TPA (100) | EG (60) | NPG (40) | — | — | TMA (10) |
| Binder resin 4 | TPA (100) | EG (60) | NPG (40) | — | — | TMA (5) |
| Binder resin 5 | TPA (100) | EG (60) | NPG (40) | — | — | TMA (5) |
| Binder resin 6 | TPA (70) | FA (30) | 1,6-Hexanediol (80) | NPG (20) | — | — |
| Binder resin 7 | TPA (100) | EG (65) | 1,3-Propanediol (5) | NPG (30) | — | — |
| Binder resin 8 | TPA (90) | FA (10) | EG (70) | 1,3-Propanediol (5) | NPG (25) | — |
| Binder resin 9 | TPA (100) | EG (60) | NPG (40) | — | — | TMA (5) |
| Binder resin 10 | TPA (100) | EG (65) | BPAEO (25) | BPAPO (10) | — | — |
| Binder resin 11 | TPA (100) | BPAEO (50) | BPAPO (50) | — | — | — |
| Binder resin 12 | TPA (80) | FA (20) | EG (75) | Methylpropanediol (5) | NPG (20) | — |
| Binder resin 13 | TPA (94) | TMA (6) | BPAPO (100) | — | — | — |
| Binder resin 14 | Binder resin 13 (70) | TPA (15) | 1,3-Propanediol (15) | — | — | — |
| Binder resin 15 | AA (95) | TMA (5) | EG (100) | — | — | — |
| Binder resin 16 | TPA (60) | TMA (6) | IPA (34) | BPAPO (100) | — | — |

TABLE 1-continued

| | Formula (mol parts) | | | | | |
|---|---|---|---|---|---|---|
| | Monomer initially added | | | | | Monomer additionally added |
| Binder resin 17 | TP A(80) | FA (20) | EG (70) | CHDM (30) | — | — |

* Wherein
BPAPO: Bisphenol A propylene oxide adduct
BPAEO: Bisphenol A ethylene oxide adduct
TPA: Terephthalic acid
AA: Adipic acid
TMA: Trimellitic anhydride
FA: Fumaric acid
NPG: Neopentyl glycol
CHDM: Cyclohexanedimethanol
EG: Ethylene glycol
IPA: Isophthalic acid

TABLE 2

| | DSC properties Tg (° C.) | Molecular weight distribution Mp | Mw | Mn | Proportion of molecular weight not more than 3000 (%) | Acid value (mgKOH/g) |
|---|---|---|---|---|---|---|
| Binder resin 1 | 58.5 | 8000 | 9000 | 4000 | 16 | 25 |
| Binder resin 2 | 58.1 | 8000 | 9000 | 4000 | 16 | 5 |
| Binder resin 3 | 57.1 | 8000 | 9000 | 4000 | 16 | 55 |
| Binder resin 4 | 55.4 | 6000 | 9000 | 3500 | 17 | 33 |
| Binder resin 5 | 59.3 | 10500 | 12000 | 6000 | 10 | 19 |
| Binder resin 6 | 60.1 | 8500 | 10000 | 5000 | 15 | 25 |
| Binder resin 7 | 58.5 | 12000 | 15000 | 8000 | 7 | 5 |
| Binder resin 8 | 58.2 | 10000 | 13000 | 6000 | 9 | 18 |
| Binder resin 9 | 49.1 | 4800 | 6500 | 3200 | 19 | 51 |
| Binder resin 10 | 59.8 | 10000 | 11000 | 5000 | 11 | 18 |
| Binder resin 11 | 58.4 | 10000 | 12000 | 6000 | 10 | 3 |
| Binder resin 12 | 49.3 | 7000 | 10000 | 4500 | 12 | 23 |
| Binder resin 13 | 57.6 | 7900 | 8500 | 4000 | 23 | 28 |
| Binder resin 14 | 62.1 | 8500 | 11000 | 9500 | 25 | 8 |
| Binder resin 15 | 70.5 | 10000 | 12000 | 6000 | 5 | 15 |
| Binder resin 16 | 58.5 | 7500 | 135000 | 6000 | 12 | 20 |
| Binder resin 17 | 63.1 | 27000 | 42000 | 9000 | 3 | 10 |

Example 1-1

| | |
|---|---|
| Binder Resin 1 | 100 parts by mass |
| Magnetic iron oxide particles (number average particle diameter = 0.20 μm, Hc = 11.5 kA/m, σs = 88 $Am^2/kg$, σr = 14 $Am^2/kg$) | 90 parts by mass |
| Polypropylene wax (VISCOL 660-P (made by Sanyo Chemical Industries, Ltd.) | 4 parts by mass |
| Charge Control Agent 1 having the structure below | 2 parts by mass |

[Formula 3]

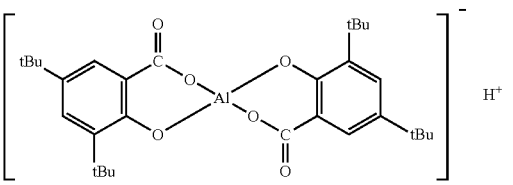

The materials were pre-mixed by a Henschel mixer, and melt kneaded as shown in Table 3 by a biaxial kneading extruder having the configuration of Ln/L=0.44 (L=110 cm).

The obtained kneaded product was cooled, crushed by a hammer mill and pulverized by a jet mill. The obtained pulverized powder was classified using a multi classifier using a Coanda effect to obtain magnetic toner particles having a weight average particle diameter (D4) of 7.0 μm and a negative charging property.

To 100 parts by mass of the magnetic toner particles, 1.0 part by mass of Hydrophobic Silica Fine Powder 1 [BET specific surface area of 150 $m^2/g$; 100 parts by mass of the silica base was hydrophobized by 30 parts by mass of hexamethyldisilazane (HMDS) and 10 parts by mass of dimethyl silicone oil], and 3.0 parts by mass of strontium titanate fine powder (D50: 1.0 μm) were externally added and mixed. The mixture was sieved out by a mesh having an opening of 150 μm to obtain Toner T-1. The physical properties of the obtained toner are shown in Table 3.

<Evaluation of Toner>

The fixing unit was dismounted from a commercially available laser beam printer (Laser Jet P4515n, made by Hewlett- Packard Company), and the printer was used as an image forming apparatus for evaluation. The dismounted fixing unit (a fixing apparatus that closely contacts a recording medium with a heating body by a pressurizing member through a film) was modified such that the fixing unit could be operated outside of the printer. The film fixing temperature could be arbitrarily set, and the fixing speed could be 400 mm/s.

<Low-Temperature Fixing Properties>

Using the image forming apparatus, a non-fixed solid black image was formed on a paper of 80 g/m$^2$. The obtained non-fixed image was passed through the fixing unit whose temperature was adjusted at 170° C., thereby to form a fixed image. A silbond sheet to which a load of 50 g/cm$^2$ was applied was rubbed against the obtained fixed image reciprocally 5 times. Based on the reduction rate (%) of the concentration of the image before and after rubbing, the low-temperature fixing properties were evaluated. The evaluation result is shown in Table 4.

A: Very good (less than 10%)

B: Good (not less than 10% and less than 15%)

C: Fair (not less than 15% and less than 20%)

D: Inferior (not less than 20% and less than 25%)

E: Bad (not less than 25%)

<Off-Set Resistance at Low Temperature>

Using the image forming apparatus, a latent image having 4-dot horizontal lines of 600 dpi (a line width of the latent image of approximately 190 μm aligned at an interval of 1 cm was formed, developed, and transferred on to a paper of 80 g/m$^2$ to form a non-fixed image. The non-fixed image was fixed by the fixing unit whose temperature was adjusted at 150° C. The off-set resistance at a low temperature was evaluated by observing reproductivity of the lines after fixing with a loupe and visually. The evaluation result is shown in Table 4.

A: Well reproduced.

B: In observation using a loupe with a magnification of 30 times, unevenness of the lines is found in part of the field.

C: Unevenness of the lines is partially found by visual observation.

D: Unevenness of the lines is entirely found by visual observation, but reduction in the concentration is not found.

E: The toner is off-set on the fixing roller, and the concentration on the paper is reduced.

<Blocking Resistance>

10 g of the toner was weighed and placed into a 50 ml PP cup, and left in a humidistat at 40° C. and 95% for 30 days. Based on the blocking state after leaving, evaluation was made according to the evaluation criteria below. The evaluation result is shown in Table 4.

A: No lump is found.

B: Lumps are slightly found, but are disentangled when the cup is shaken.

C: Lumps are found, and become smaller and disentangled when the cup is shaken.

D: No large lumps are found, but lumps remain even if the cup is shaken.

E: Large lumps are found, and not disentangled even if the cup is shaken.

Example 1-2 to Example 1-14

Using the formula and the configuration of a kneader shown in Table 3, Toners T-2 to T-14 were produced in the same manner as in Example 1-1. The distance L of the raw material feeding inlet to the end downstream of a paddle in the kneader was not changed. The physical properties of the obtained toners are shown in Table 3. The result of the test performed in the same manner as in Example 1-1 is shown in Table 4.

Charge Control Agent 2 shown in Table 3 is a compound having a structure below:

[Formula 4]

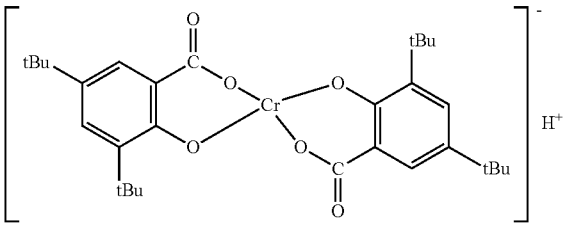

Comparative Examples 1 to 10

Using the formula and the configuration of a kneader shown in Table 3, Toners T-15 to T-24 were produced in the same manner as in Example 1-1. The distance L of the raw material feeding inlet to the end downstream of a paddle in the kneader was not changed. The physical properties of the obtained toners are shown in Table 3. The result of the test performed in the same manner as in Example 1-1 is shown in Table 4.

Charge Control Agent 3 shown in Table 3 is a compound having a structure below:

[Formula 5]

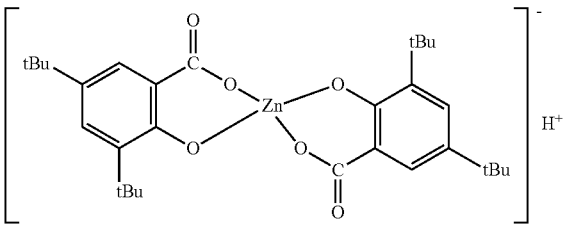

The charge control resin shown in Table 3 is a copolymer of acrylamidemethylpropanesulfonic acid and styrene (polymerization average molecular weight of 28,000, Tg of 78° C.).

TABLE 3

| | Toner No. | Binder resin No. (mass ratio) | Charge control agent No. | Proportion of kneading section Ln/L | Glass transition temperature of toner (° C.) | Difference of heat flow (W/g) | G'40 (Pa) | G'70 (Pa) |
|---|---|---|---|---|---|---|---|---|
| Example 1-1 | T-1 | Binder resin 1 | 1 | 0.44 | 58.5 | 0.071 | $1.2 \times 10^9$ | $3.5 \times 10^6$ |
| Example 1-2 | T-2 | Binder resin 1 | 2 | 0.44 | 58.6 | 0.069 | $1.7 \times 10^9$ | $8.2 \times 10^6$ |
| Example 1-3 | T-3 | Binder resin 1 | 1 | 0.33 | 57.9 | 0.071 | $1.0 \times 10^9$ | $1.1 \times 10^5$ |
| Example 1-4 | T-4 | Binder resin 2 | 1 | 0.44 | 58.1 | 0.074 | $9.8 \times 10^8$ | $5.5 \times 10^5$ |
| Example 1-5 | T-5 | Binder resin 3 | 1 | 0.44 | 57.5 | 0.064 | $1.5 \times 10^9$ | $1.0 \times 10^7$ |
| Example 1-6 | T-6 | Binder resin 1/Binder resin 17 (70/30) | 1 | 0.44 | 59.2 | 0.073 | $1.2 \times 10^9$ | $4.8 \times 10^6$ |
| Example 1-7 | T-7 | Binder resin 1/Binder resin 16 (70/30) | 1 | 0.44 | 56.9 | 0.079 | $1.2 \times 10^9$ | $4.9 \times 10^6$ |
| Example 1-8 | T-8 | Binder resin 4 | 1 | 0.44 | 55.5 | 0.070 | $1.0 \times 10^9$ | $1.5 \times 10^6$ |
| Example 1-9 | T-9 | Binder resin 5 | 1 | 0.44 | 59.5 | 0.063 | $1.0 \times 10^9$ | $1.0 \times 10^7$ |
| Example 1-10 | T-10 | Binder resin 5 | 2 | 0.33 | 59.7 | 0.067 | $1.9 \times 10^9$ | $9.9 \times 10^6$ |
| Example 1-11 | T-11 | Binder resin 6 | 1 | 0.44 | 54.9 | 0.073 | $1.1 \times 10^9$ | $1.2 \times 10^6$ |
| Example 1-12 | T-12 | Binder resin 7 | 1 | 0.44 | 58.7 | 0.069 | $8.8 \times 10^8$ | $5.5 \times 10^6$ |
| Example 1-13 | T-13 | Binder resin 8 | 1 | 0.44 | 58.4 | 0.074 | $9.8 \times 10^8$ | $4.9 \times 10^6$ |
| Example 1-14 | T-14 | Binder resin 8 | 2 | 0.75 | 58.6 | 0.063 | $1.1 \times 10^9$ | $1.0 \times .10^7$ |
| Comparative Example 1 | T-15 | Binder resin 9 | 1 | 0.44 | 49.5 | 0.059 | $6.9. \times 10^8$ | $9.8 \times 10^4$ |
| Comparative Example 2 | T-16 | Binder resin 10 | 2 | 0.44 | 60.2 | 0.036 | $1.0 \times 10^9$ | $2.0 \times 10^7$ |
| Comparative Example 3 | T-17 | Binder resin 11 | 3 | 0.44 | 59.1 | 0.031 | $1.0 \times 10^9$ | $1.5 \times 10^7$ |
| Comparative Example 4 | T-18 | Binder resin 12 | 1 | 0.44 | 49.5 | 0.044 | $2.2 \times 10^9$ | $2.3 \times 10^7$ |
| Comparative Example 5 | T-19 | Binder resin 13 | 1 | 0.44 | 57.5 | 0.034 | $6.8 \times 10^8$ | $9.0 \times 10^6$ |
| Comparative Example 6 | T-20 | Binder resin 1 | Charge control resin | 0.75 | 58.4 | 0.071 | $6.7 \times 10^8$ | $8.5 \times 10^4$ |
| Comparative Example 7 | T-21 | Binder resin 1 | Charge control resin | 0.33 | 57.5 | 0.073 | $2.1 \times 10^9$ | $1.1 \times 10^7$ |
| Comparative Example 8 | T-22 | Binder resin 5 | Charge control resin | 0.75 | 60.1 | 0.056 | $1.5 \times 10^9$ | $3.2 \times 10^7$ |
| Comparative Example 9 | T-23 | Binder resin 13/Binder resin 15 (90/10) | 2 | 0.44 | 45.5 | 0.061 | $9.8 \times 10^8$ | $5.3 \times 10^7$ |
| Comparative Example 10 | T-24 | Binder resin 14/Binder resin 16 (70/30) | 1 | 0.44 | 47.1 | 0.056 | $1.5 \times 10^9$ | $1.5 \times 10^7$ |

TABLE 4

| | Off-set resistance at low temperature | Low-temperature fixing properties | Blocking resistance |
|---|---|---|---|
| Example 1-1 | A | A | A |
| Example 1-2 | A | B | A |
| Example 1-3 | B | A | A |
| Example 1-4 | B | A | B |
| Example 1-5 | A | B | A |
| Example 1-6 | A | A | A |
| Example 1-7 | A | A | A |
| Example 1-8 | A | A | A |
| Example 1-9 | A | C | A |
| Example 1-10 | A | C | A |
| Example 1-11 | C | A | B |
| Example 1-12 | A | B | B |
| Example 1-13 | A | C | B |
| Example 1-14 | A | C | A |
| Comparative Example 1 | E | B | E |
| Comparative Example 2 | E | E | B |
| Comparative Example 3 | E | E | B |
| Comparative Example 4 | D | E | C |
| Comparative Example 5 | E | E | E |
| Comparative Example 6 | E | C | E |
| Comparative Example 7 | D | E | D |
| Comparative Example 8 | E | E | B |

TABLE 4-continued

| | Off-set resistance at low temperature | Low-temperature fixing properties | Blocking resistance |
|---|---|---|---|
| Comparative Example 9 | E | D | E |
| Comparative Example 10 | E | E | E |

Embodiment 2

<Production of Binder Resin 18>

| | |
|---|---|
| Terephthalic acid | 100 mol parts |
| Ethylene glycol | 60 mol parts |
| Neopentyl glycol | 40 mol parts |
| Long-chain diol B (carbon atoms (C) = 50, number average molecular weight Mn = 700, melting point = 105° C.) | 2 mol parts |

(Concerning the diol B, assuming the molecular weight to be 700, the "mol %" was calculated.)

The polyester monomer and an esterification catalyst (dibutyltin oxide) were placed into a 5 l autoclave. To the autoclave, a reflux cooler, a moisture separator, an $N_2$ gas introducing pipe, a thermometer, and a stirrer were attached.

While $N_2$ gas was introduced into the autoclave, a polycondensation reaction was performed at 230° C. The reaction was performed while a degree of the progression of the reaction was monitored using viscosity. When the monitored viscosity reached the target viscosity, 5 mol parts of trimellitic anhydride was added. The relationship between the viscosity and the molecular weight was separately confirmed, and the target viscosity was determined in advance. After the reaction was completed, the produced resin was extracted from the container, cooled, and pulverized to obtain Binder Resin 18. The physical properties of Binder Resin 18 are as shown in Table 2.

<Production of Binder Resins 19 and 20>

Binder Resins 19 and 20 were produced in the same manner as in Binder Resin 18 except that the monomer shown in Table 5 was used. The physical properties of these resins are as shown in Table 6.

TABLE 5

| | Formula (mol parts) | | | | | |
|---|---|---|---|---|---|---|
| | Monomer initially added | | | | | Monomer additionally added |
| Binder resin 18 | TPA (100) | EG (60) | NPG (40) | — | Long-chain diol B (2) | TMA (5) |
| Binder resin 19 | TPA (70) | FA (30) | 1,6-Hexanediol (80) | NPG (20) | Long-chain diol A (3) | — |
| Binder resin 20 | TPA (90) | FA (10) | EG (70) | 1,3-Propanediol (5) | Long-chain diol C (3) | — |

* Wherein
TPA: Terephthalic acid
TMA: Trimellitic anhydride
FA: Fumaric acid
NPG: Neopentyl glycol
EG: Ethylene glycol
Long-chain diol A: C30, Mn400, Melting point 80
Long-chain diol B: C50, Mn700, Melting point 105
Long-chain diol C: C70, Mn1000, Melting point 117

TABLE 6

| | DSC properties | | | | | Molecular weight distribution | | | | |
|---|---|---|---|---|---|---|---|---|---|---|
| | Tg (° C.) | P1 (° C.) | P2 (° C.) | Relationship between amounts of heat to be absorbed | ΔH2 (J/g) | Mp | Mw | Mn | Proportion of molecular weight not more than 3000 (%) | Acid value (mgKOH/g) |
| Resin-18 | 58.5 | 63 | 107 | ΔH1 < ΔH2 | 0.83 | 8000 | 9000 | 4000 | 15 | 22 |
| Resin-19 | 54.9 | 56 | 83 | ΔH1 < ΔH2 | 1.75 | 8500 | 10000 | 5000 | 16 | 23 |
| Resin-20 | 58.4 | 64 | 117 | ΔH1 < ΔH2 | 1.9 | 10000 | 13000 | 6000 | 10 | 3 |

Example 2-1 to Example 2-3

Using the formula and the configuration of a kneader shown in Table 7, Toners T-25 to T-27 were produced in the same manner as in Example 1-1. The distance L of the raw material feeding inlet to the end downstream of a paddle in the kneader was not changed. The physical properties of the obtained toners are shown in Table 7. The test was performed in the same manner as in Example 1-1 except that the speed of the fixing apparatus was 500 mm/s. The result is shown in Table 8.

TABLE 7

| | Toner No. | Binder resin No. (mass ratio) | Charge control agent No. | Proportion of kneading section Ln/L | Glass transition temperature of toner (° C.) | Difference of heat flow (W/g) | G'40 (Pa) | G'70 (Pa) |
|---|---|---|---|---|---|---|---|---|
| Example 2-1 | T-25 | Binder resin 18 | 1 | 0.44 | 58.5 | 0.071 | $1.2 \times 10^9$ | $3.5 \times 10^6$ |
| Example 2-2 | T-26 | Binder resin 19 | 1 | 0.44 | 54.9 | 0.069 | $1.1 \times 10^9$ | $1.2 \times 10^6$ |
| Example 2-3 | T-27 | Binder resin 20 | 1 | 0.44 | 58.4 | 0.071 | $9.8 \times 10^9$ | $4.9 \times 10^6$ |

TABLE 8

| | Off-set resistance at low temperature | Low-temperature fixing properties | Blocking resistance |
|---|---|---|---|
| Example 2-1 | A | A | A |
| Example 2-2 | A | A | A |
| Example 2-3 | A | A | A |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-293014, filed Dec. 28, 2010, which is hereby incorporated by reference herein in its entirety.

The invention claimed is:

1. A toner comprising toner particles each of which contains a binder resin and a coloring agent, wherein:

in a DSC curve as measured with a differential scanning calorimeter, the toner has a glass transition temperature of not less than 50° C. and not more than 60° C.; and the toner has, in regard to a resin composition contained therein, a difference of not less than 0.060 W/g in heat flow between a point on the curve at a temperature of 40° C. and a baseline in the range exceeding the glass transition temperature; and in viscoelastic characteristics measured at a frequency of 6.28 rad/sec, the toner has a storage elastic modulus (G'40) at a temperature of 40° C. of not less than $7.0\times10^8$ Pa and not more than $2.0\times10^9$ Pa, and a storage elastic modulus (G'70) at a temperature of 70° C. of not less than $1.0\times10^5$ Pa and not more than $1.0\times10^7$ Pa, wherein, in the DSC curve as measured with a differential scanning calorimeter, the binder resin has a first endothermic peak P1 at a temperature of not less than 55° C. and not more than 75° C. and a second endothermic peak P2 at a temperature of not less than 80° C. and not more than 120° C.; and the endothermic calorie at the first endothermic peak P1, ΔH1, and the endothermic calorie at the second endothermic peak P2, ΔH2, is in a relationship of $\Delta H1 \leq \Delta H2$, and wherein the binder resin is a crystalline polyester.

2. The toner according to claim 1, wherein the endothermic calorie at the second endothermic peak P2 is not less than 0.20 J/g and not more than 2.00 J/g.

3. The toner according to claim 1, wherein, in molecular weight distribution as measured by gel permeation chromatography (GPC) of a THF-soluble matter, the binder resin has at least one peak in a molecular weight region of not less than 5,000 and not more than 10,000 and, in a chart of the GPC, has an area of a peak in a molecular weight region of not more than 3,000, of not more than 20% based on the whole area of peaks.

* * * * *